US009635946B2

(12) United States Patent
Wang et al.

(10) Patent No.: US 9,635,946 B2
(45) Date of Patent: May 2, 2017

(54) CHAIR FOOTREST FRAME

(71) Applicant: ZHEJIANG HENGLIN CHAIR INDUSTRY CO., LTD., Huzhou, Zhejiang (CN)

(72) Inventors: Jianglin Wang, Zhejiang (CN); Zhengxing Wang, Zhejiang (CN)

(73) Assignee: ZHEJIANG HENGLIN CHAIR INDUSTRY CO., LTD., Huzhou (CN)

( * ) Notice: Subject to any disclaimer, the term of this patent is extended or adjusted under 35 U.S.C. 154(b) by 30 days.

(21) Appl. No.: 14/763,819

(22) PCT Filed: Sep. 11, 2013

(86) PCT No.: PCT/CN2013/083292
§ 371 (c)(1),
(2) Date: Jul. 27, 2015

(87) PCT Pub. No.: WO2014/121609
PCT Pub. Date: Aug. 14, 2014

(65) Prior Publication Data

US 2015/0359343 A1 Dec. 17, 2015

(30) Foreign Application Priority Data

Feb. 7, 2013 (CN) ..... 2013 2 0071075 U

(51) Int. Cl.
*A47C 7/50* (2006.01)
*A47C 20/00* (2006.01)

(52) U.S. Cl.
CPC ..... *A47C 7/506* (2013.01)

(58) Field of Classification Search
CPC ..... A47C 7/506
USPC ..... 297/423.2
See application file for complete search history.

(56) References Cited

U.S. PATENT DOCUMENTS 793,171 A * 6/1905 Bartlett ..... A47C 3/28 297/423.2 X
917,184 A * 4/1909 Tate ..... A47C 7/506 297/423.2
1,125,167 A * 1/1915 Pepper ..... A47C 1/03255 297/423.2 X
1,435,744 A * 11/1922 Santaniello ..... A47L 23/16 297/423.2 X (Continued)

FOREIGN PATENT DOCUMENTS

CN 201008456 Y 1/2008

OTHER PUBLICATIONS

International Search Report of PCT Patent Application No. PCT/CN2013/083292 issued on Nov. 28, 2013.

*Primary Examiner* — Rodney B White

(57) ABSTRACT

Disclosed is a chair footrest frame, comprising a base sliding block (1) fixed to both sides of a bottom face of a chair base, sliding rods (2) arranged in a sliding manner respectively on the base sliding blocks (1), a footrest cushion (7) provided between the two sliding rods (2), and a roller ball (12) suitable for the sliding of the sliding rods (2) being provided on the base sliding block (1). The frictional force between the sliding rods and the base sliding block is relatively small, abrasive wear is relatively low, and operation is simple and convenient, which benefit improvement of the functionality and service life of the footrest frame.

9 Claims, 5 Drawing Sheets

(56) References Cited

U.S. PATENT DOCUMENTS 1,984,281 A * 12/1934 Poggendorf ..... A47C 1/032 297/423.2 X
2,169,550 A * 8/1939 Arends ..... A47C 3/029 297/423.2 X
2,480,300 A * 8/1949 Luketa ..... A47C 1/037 297/423.2 X
2,481,970 A * 9/1949 Bell ..... B61D 33/005 297/423.2 X
2,762,422 A * 9/1956 Stratton ..... A47C 1/0244 297/423.22 X
3,295,885 A * 1/1967 Barksdale ..... A47C 3/025 297/423.2 X
4,364,603 A * 12/1982 Johnson ..... A47C 1/0352 297/68 X
4,411,472 A * 10/1983 Kassai ..... B62B 7/08 297/423.2 X
4,455,050 A * 6/1984 Kubek ..... A61G 5/12 297/423.2
4,715,654 A * 12/1987 Laskowitz ..... A47C 1/0248 297/423.2 X
5,312,161 A * 5/1994 Mars ..... A47C 7/506 297/423.2
5,588,708 A * 12/1996 Rykken ..... A47C 7/506 297/423.2 X
6,145,931 A * 11/2000 Subotic ..... A47C 16/025 297/423.2 X
6,935,962 B1 * 8/2005 Tseng ..... A47C 1/023 297/423.2
7,108,322 B2 * 9/2006 Erker ..... B60N 2/4495 297/423.2 X
7,325,878 B1 * 2/2008 Dehli ..... A47C 7/506 297/423.2
7,621,599 B2 * 11/2009 Whalen ..... A47C 7/50 297/423.2
9,016,797 B2 * 4/2015 Iida ..... B60N 2/0252 297/423.2 X
9,155,394 B1 * 10/2015 Cohen ..... A47C 7/506
2004/0189074 A1 * 9/2004 Seki ..... B60N 3/063 297/423.1

* cited by examiner

CHAIR FOOTREST FRAME

BACKGROUND

Technical Field

The present invention relates to household and office supplies, in particular to chairs, specifically to a chair footrest frame.

Description of Related Art

At present, integrated footrests available on the market have replaced original separated footrests, thus greatly saving space. Chair feet with extensible footrests effectively hide the footrests below the base, avoiding the footrests from affecting the overall appearance of the chairs. Utility model CN201008456Y discloses a chair with a footrest, comprising a seat cushion arranged on a bottom frame; the left and right sides of said bottom frame are fixedly equipped with guide rails; the guide rails are internally provided with sliding rails; the sliding rails are fixedly connected with the footrest. Such sliding setting tends to wear the guide rails and the sliding rails.

BRIEF SUMMARY

The objective of the present invention is to provide a chair footrest. The frictional force between a sliding rods and a base sliding block is relatively low, abrasive wear is relatively low, and operation is simple and convenient, which benefit improvement of the functionality and service life of the footrest frame.

The technical objective of the present invention is fulfilled through the following technical solution: A chair footrest frame comprising a base sliding block fixed to both sides of a bottom face of a chair base, sliding rods arranged in a sliding manner respectively on the base sliding blocks, and a footrest cushion provided between the two sliding rods, and a roller ball suitable for the sliding of the sliding rods being provided on the base sliding block.

Preferably, each base sliding block is provided with a sliding hole sleeved with the sliding rod, and the roller ball is disposed between an inner wall of the sliding hole and an outer wall of the sliding rod.

Preferably, the sliding hole is internally provided with a roller frame, and the roller frame is formed with a slot for embedding the roller ball.

Preferably, the width of the slot is smaller than the diameter of the roller ball.

Preferably, the slot is strip-like or shaped as a round hole corresponding to the roller ball.

Preferably, a rotating central shaft in rotational connection with the sliding rod is arranged between the two sliding rods, and the rotating central shaft is provided with angle iron fixtures for fixing the footrest cushion.

Preferably, each sliding rod is provided with a plastic sliding block; the plastic sliding block is formed with openings and sliding chutes coaxial with the openings; the two ends of the rotating central shaft are respectively sleeved in corresponding openings; and the sliding chutes are in sliding connection with locating pins capable of resisting the two ends of the sliding chutes and linking with the rotating central shaft.

Preferably, the radian formed by the sliding chutes is $2\pi/3$-$\pi$.

Preferably, the footrest cushion is provided with a magnet.

Preferably, the plastic sliding block is formed with a clamping groove; each base sliding block is fixedly connected with a spring plate with a projection matched with the clamping groove.

When the prevent invention is folded below the chair base, the projection on the spring plate is clamped in the clamping groove such that the present invention does not generate unnecessary sliding when the chair is turned.

In conclusion, the present invention has the following beneficial effects: it is simply structured and easy to implement; the special setting of the base sliding blocks helps reduce the friction coefficient between the sliding rods and the base sliding block, thus reducing wearing and contributing to prolonging the service life of the chair footrest frame; the rotating central shaft rotates in the rotating shaft such that the footrest cushion fixed at the angle iron fixtures is turned out or slides into the area between the sliding rods, which benefits to reducing the length of the footrest frame in the folded state and further compaction of the chair structure; the footrest cushion is provided with magnets, so when the footrest cushion is folded below the chair base, the magnets and a tray below the chair base generate a magnetic absorption force there-between, and then the chair footrest frame does not generate unnecessary sliding when the chair is turned; the arrangement of the clamping groove and the spring plate helps further avoid the chair footrest frame folded below the chair base from unnecessary sliding when the chair is turned.

Figure 1:
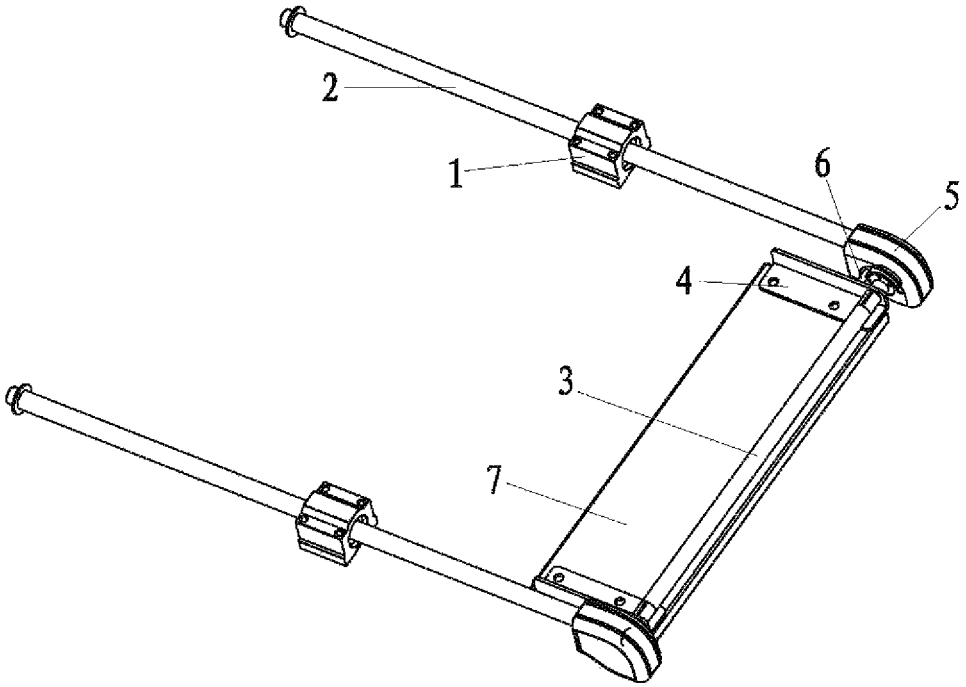
FIG. 1 is a structural view of embodiment 1.
Figure 2:
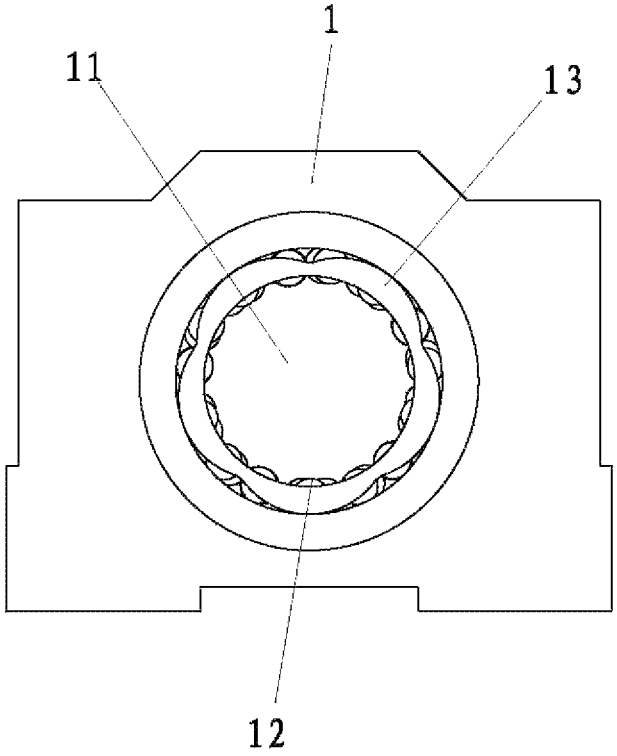
FIG. 2 is a structural view of the base sliding block in embodiment 1
Figure 3:
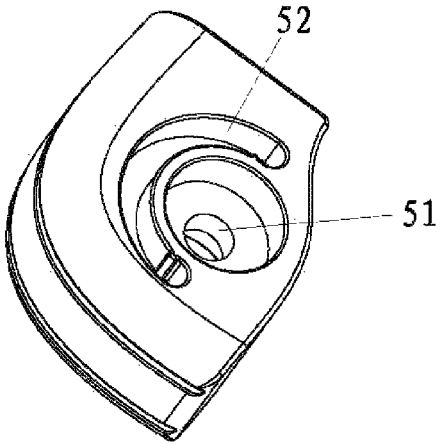
FIG. 3 is a structural view of the plastic sliding block in embodiment 1.
Figure 4:
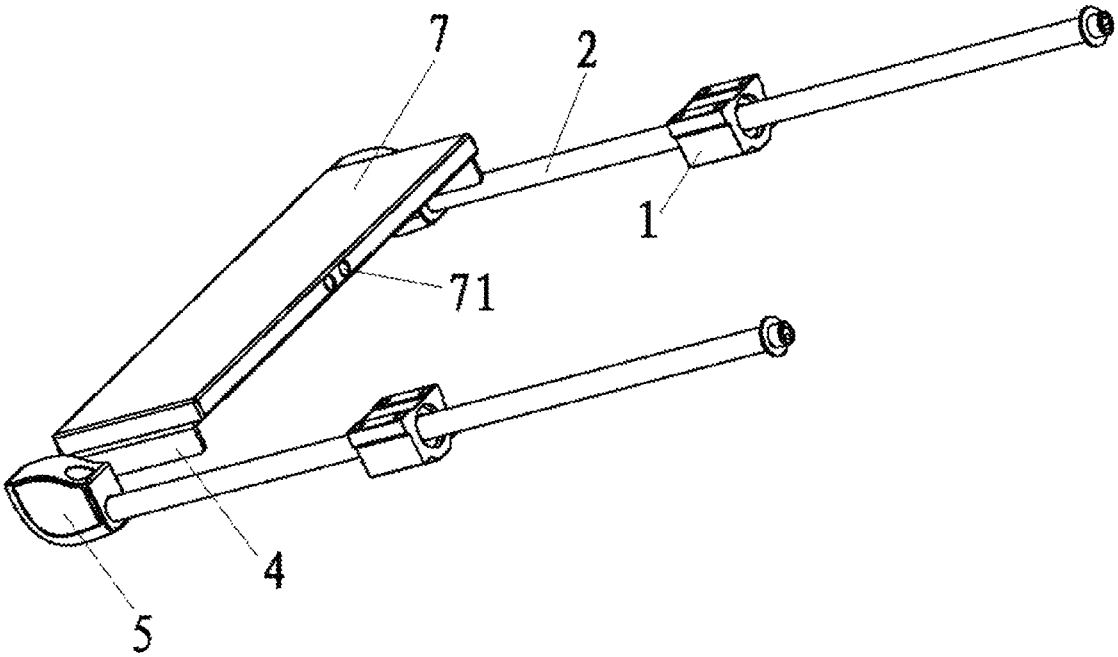
FIG. 4 is a structural view of embodiment 1 at another angle of view.

As shown in the figures, 1—base sliding block, 11—sliding hole, 12—roller ball, 13—roller frame, 14—spring plate, 141—projection, 2—sliding rod, 5—plastic sliding block, 51—opening, 52—sliding chute, 53—clamping groove, 3—rotating central shaft, 4—angle iron fixture, 6—locating pin, 7—footrest cushion, 71—magnet, 72—mounting frame.

DETAILED DESCRIPTION

The present invention is described in further detail with reference to the attached drawings.

The embodiments are used only to explain the present invention, and do not limit the scope of the present invention. Those skilled in this field may easily fashion noncreative modifications according to the embodiments after reading the Description, and all modifications shall fall within the protection scope of the claims in accordance with the Patent Law.

Embodiment 1

As shown in FIGS. 1-4, a chair footrest frame comprises a base sliding block 1 fixed to both sides of a chair base; each base sliding block 1 is provided with a sliding hole 11; the sliding hole 11 is internally provided with a roller frame 13;

the two ends of the sliding hole 11 are provided with retainer rings for preventing the roller frame 12 from sliding out of the sliding hole 11. The retainer rings are not shown in the figure. The roller frame 13 is formed with a slot provided with a roller ball 12 inside; the width of the slot is a little smaller than the diameter of the roller ball 12; the sliding hole 11 is internally sleeved with a sliding rod 2, and the roller frame 13 is located between the sliding rod 2 and the sliding hole 11 such that the roller ball 12 is located between the outer wall of the sliding rod 2 and the inner wall of the sliding hole 11. The slot is not shown in the figures, One end of the sliding rod 2 is fixedly provided with a plastic sliding block 5. The plastic sliding block 5 is formed with openings 51 and sliding chutes 52 coaxial with the openings 51. The radian formed by the sliding chute 52 is $2\pi/3-\pi$, preferably $35\pi/36-\pi$, $35\pi/36$ in this embodiment. Two openings 51 are in rotary connection with a rotating central shaft. The two sides of the rotating central shaft 3 are fixedly connected with angle iron fixtures 4 inside. The angle iron fixtures 4 are used to fix the footrest cushion 7.

The sliding chutes 52 are in sliding connection with locating pins 6 capable of resisting two ends of the sliding chute 52 and linking with the rotating central shaft 3. In this embodiment, the locating pins 6 are located at the angle iron fixtures 4. To fold the chair footrest frame, rotate the rotating central shaft 3 to drive the locating pins 6 to press against the inner ends of the sliding chutes 52 such that the footrest cushion 7 is completely located between the two sliding rods 2 and then pushed below the chair base through the sliding rods 2. To unfold the chair footrest frame, pull out the footrest cushion 7 through the sliding rods 2, rotate the rotating central shaft 3 to drive the locating pins 6 to press against the outer ends of the sliding chutes 52, and then the chair footrest frame can be used.

In order to prevent the chair footrest frame from sliding when the chair is turned, one side wall of the footrest cushion 7 is provided with a magnet 71 such that when the footrest cushion is folded below the chair base, the magnet 71 and the tray below the chair base can generate a magnetic absorption force there-between.

Meanwhile, the base sliding block in this embodiment may be other structures, for example, the base sliding block is formed with linear grooves, the sliding rods slide in the grooves, and the grooves are provided with roller balls suitable for the sliding of the sliding rods.

Embodiment 2

Figure 5:
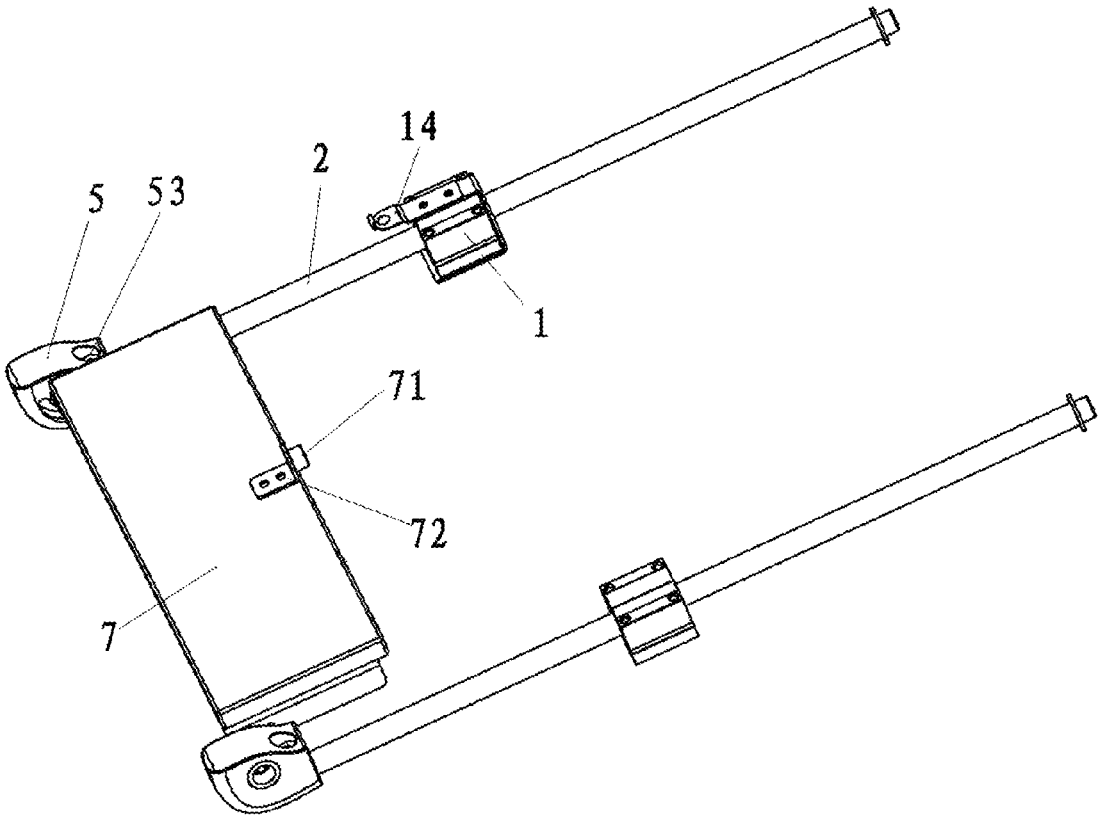
FIG. 5 is a structural view of embodiment 2.
Figure 6:
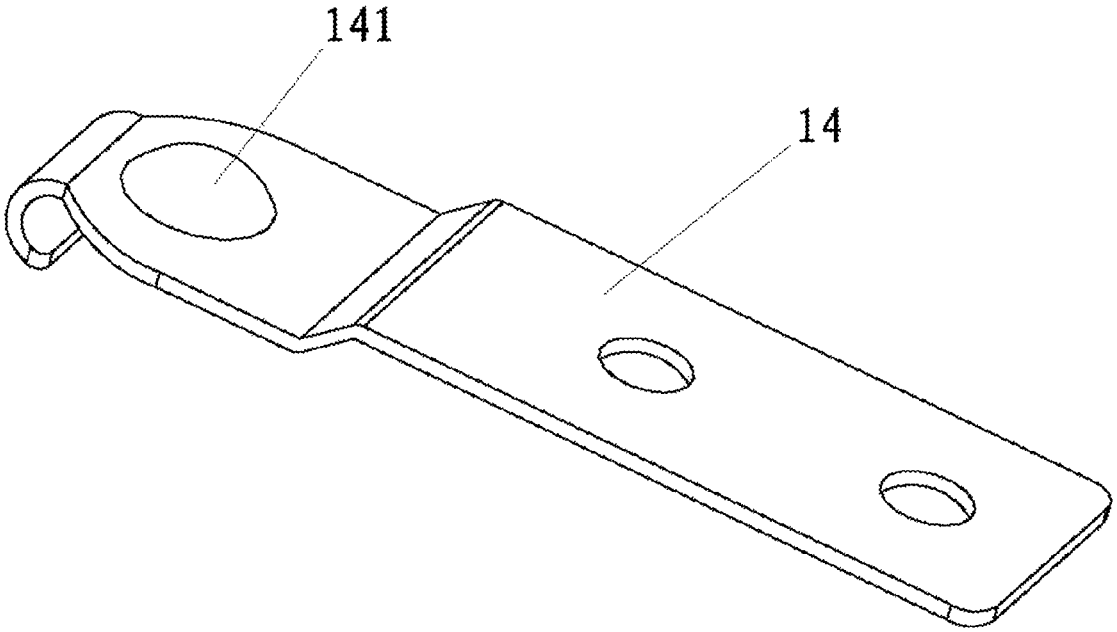
FIG. 6 is a structural view of the spring plate in embodiment 2.

Different from Embodiment 1 in that, as shown in FIGS. 5-6, the plastic sliding block 5 is formed with a clamping groove 53; the base sliding block 1 is fixedly connected with a spring plate 14 with a projection 141 matched with the clamping groove 53; and, one surface of the footrest cushion 7 is fixedly equipped with a mounting frame 72 on which the magnet 71 is fixed.

What is claimed is:

1. A chair footrest frame, comprising a base sliding block (1) fixed to both sides of a bottom face of a chair base, two sliding rods (2) arranged in a sliding manner respectively on the base sliding blocks (1), and a footrest cushion (7) provided between the two sliding rods (2), wherein a roller ball (12) suitable for the sliding of the sliding rods (2) is provided on the base sliding block (1); wherein a rotating central shaft (3) in rotational connection with the two sliding rods (2) is arranged between the two sliding rods (2), and the rotating central shaft (3) is provided with angle iron fixtures (4) for fixing the footrest cushion (7); and each sliding rod (2) is provided with a plastic sliding block (5); the plastic sliding block (5) is formed with openings (51) and sliding chutes (52) coaxial with the openings (51); two ends of the rotating central shaft (3) are respectively sleeved in corresponding openings (51); and the sliding chutes (52) are in sliding connection with locating pins (6) capable of resisting to two ends of the sliding chutes (52) and linking with the rotating central shaft (3).

2. The chair footrest frame according to claim 1, wherein each base sliding block (1) is provided with a sliding hole (11) sleeved with a corresponding sliding rod (2), and the roller ball (12) is disposed between an inner wall of the sliding hole (11) and an outer wall of the corresponding sliding rod (2).

3. The chair footrest frame according to claim 2, wherein the sliding hole (11) is internally provided with a roller frame (13), and the roller frame (13) is formed with a slot for embedding the roller ball (12).

4. The chair footrest frame according to claim 3, wherein the width of the slot is smaller than the diameter of the roller ball (12).

5. The chair footrest frame according to claim 4, wherein the slot is shaped as a strip or shaped as a round hole corresponding to the roller ball (12).

6. The chair footrest frame according to claim 3, wherein the slot is shaped as a strip or shaped as a round hole corresponding to the roller ball (12).

7. The chair footrest frame according to claim 1, wherein the radian formed by the sliding chutes (52) is $2\pi/3-\pi$.

8. The chair footrest frame according to claim 1, wherein the footrest cushion (7) is provided with a magnet (71) such that when the footrest cushion (7) is folded below the chair base, the magnet (71) and a tray below the chair base generate a magnetic absorption force therebetween.

9. The chair footrest frame according to claim 1, wherein the plastic sliding block (5) is formed with a clamping groove (53); each base sliding block (1) is fixedly connected with a spring plate (14) with a projection (141) matched with the clamping groove (53).

* * * * *